US005213087A

United States Patent [19]

Sausner et al.

[11] Patent Number: 5,213,087

[45] Date of Patent: May 25, 1993

[54] DEVICE FOR SUPPLYING COMBUSTED GASES TO THE COMBUSTION CHAMBER OF AN INTERNAL COMBUSTION ENGINE AT A CONTROLLED RATE

[75] Inventors: Andreas Sausner, Frankfurt am Main; Sebastian Zabeck, Hemsbach, both of Fed. Rep. of Germany

[73] Assignee: Firma Carl Freudenberg, Weinheim/Bergstrasse, Fed. Rep. of Germany

[21] Appl. No.: 772,802

[22] Filed: Oct. 8, 1991

[30] Foreign Application Priority Data

Nov. 6, 1990 [DE] Fed. Rep. of Germany ..... 4035176

[51] Int. Cl.[5] ..... F02M 25/07; F02D 9/10

[52] U.S. Cl. ..... 123/568; 123/400

[58] Field of Search ..... 123/400, 568, 569, 571

[56] References Cited

U.S. PATENT DOCUMENTS

| | | | |
|---|---|---|---|
| 3,675,633 | 7/1972 | Nakajima et al. | 123/568 |
| 3,882,837 | 5/1975 | Horie et al. | 123/568 |
| 3,989,018 | 11/1976 | Beier | 123/568 |
| 4,144,856 | 3/1979 | Tsukamoto et al. | 123/568 |
| 4,149,503 | 4/1979 | Ozaki et al. | 123/568 |
| 4,171,688 | 10/1979 | Takahashi | 123/568 |
| 4,198,940 | 4/1980 | Ishida | 123/568 |
| 4,224,912 | 9/1980 | Tanaka | 123/568 |
| 4,233,946 | 11/1980 | Yorioka et al. | 123/568 |
| 4,799,468 | 1/1989 | Farquhar | 123/400 |

*Primary Examiner*—Willis R. Wolfe

*Attorney, Agent, or Firm*—Sprung Horn Kramer & Woods

[57] ABSTRACT

A device for supplying combusted gases at a controlled rate to the combustion chamber of an internal combustion engine having an intake pipe that accommodates a throttle (3) and an exhaust pipe. The intake pipe and exhaust pipe communicate through an exhaust gas recycling pipe with a shut-off valve (1) accommodated therein. Means (4) that operate the shut-off valve (1) and the throttle (3) can be activated only in common and by a common activating mechanism.

9 Claims, 2 Drawing Sheets

DEVICE FOR SUPPLYING COMBUSTED GASES TO THE COMBUSTION CHAMBER OF AN INTERNAL COMBUSTION ENGINE AT A CONTROLLED RATE

BACKGROUND OF THE INVENTION

The present invention relates to a device for supplying combusted (i.e., exhaust) gases at a controlled rate to the combustion chamber of an internal combustion engine. More particularly, the present invention relates to a device for an internal combustion engine having an intake pipe with a throttle and an exhaust pipe, the device including a pipe which connects the exhaust pipe with the intake pipe and includes a shut-off valve for controlling the rate of flow from the exhaust pipe to the intake pipe.

A device if this type is known from the manual *Autoelektrik, Autoelektronik am Ottomotor* published by Bosch GmbH, Germany. Since the throttle and shut-off valve have mutually independent controls, the known device is extremely expensive to manufacture. It is also not very reliable.

SUMMARY OF THE INVENTION

The object of the present invention is to reduce the cost of manufacturing and to enhance the reliability of a device of the aforesaid type.

This object, as well as other objects which will become apparent from the discussion that follows, are achieved, in accordance with the present invention by providing a common activating mechanism so that the means that operate the shut-off valve and the means that operate the throttle in accordance with the invention can be activated only in common. The device is accordingly cost-effective to manufacture and install. It is also characterized by excellent reliability surprisingly accompanied by a definite decrease in the emission of environmentally deleterious exhaust gases even without additional electronic controls. The device in accordance with the invention is particularly advantageous for those types of internal combustion engines that require low-cost parts.

The device's overall design is dictated by the design of the means that operate the shut-off valve and the throttle. Normally it is assumed that the throttle is rigidly secured to a shaft that rotates to position it. The open cross-section of a shut-off valve on the other hand is usually varied by moving an adjusting component back and forth in a straight line. To operate both a shut-off valve and a throttle together, accordingly, a mechanism is required that can convert a linear displacement into a rotation. Many such mechanisms are known in the art.

The activating mechanism can be a spindle. This approach makes it possible to position the means that operate the shut-off valve on an axis of linear displacement that constitutes a projection of the axis the throttle shaft rotates around. Manufacture is in this case especially simple; another advantage is that the housing for the shut-off valve can be in the immediate vicinity of the intake pipe and even be integrated into it.

The activating mechanism can be a cam. This approach simplifies adapting the throttle-opening characteristics to the shut-off valve's opening characteristics and optimizes the operations of the particular internal combustion engine. It is practical for such a cam to be replaceable, allowing one and the same device to be adapted to internal combustion engines of different sizes just by installing the appropriate cam.

The activating mechanism can also be a rack and pinion. This approach makes it possible to position the throttle shaft remotely from the valve's adjusting component. A similar advantage derives from an embodiment wherein the activating mechanism is a connecting rod. Although manufacturing costs are comparatively low in the latter case, it is necessary to generate a preliminary static load, with a compression pressure, for example, to suppress undesirable play.

When valves with an adjusting component that is activated by relative rotation are employed, on the other hand, it is possible to attach the throttle shaft to the valve's adjusting-component shaft with a thrust rod. This approach also makes it possible to purposefully adapt the opening characteristics to each other in accordance with the radial intervals between the thrust rod's point of articulation and the adjusting component's axis of rotation.

Bowden cables make it possible to prevent the transmission of vibrations between the shut-off valve and the throttle shaft. This approach will extend the device's life. It is also possible to employ cogs for the activating mechanism.

The means that operate the shut-off valve can include a servo mechanism controlled through an electric, hydraulic, or pneumatic clutch by the throttle or its activating mechanism. The valve-activating characteristics in such an embodiment can be very simply adapted to the demands of the specific application.

To maintain constant activating characteristics in a device in accordance with the invention over a very long life, it has been demonstrated as practical for the shut-off valve to have a closing mechanism that engages a valve seat, whereby the closing mechanism and/or the valve seat interlocks with the particular associated means of activation or attachment along the direction of displacement, such that there will always be a transitional cross-section of equal size when the shut-off valve is open. The valve seat can, for example, be the face of a pipe that parallels the axis of displacement of the closing mechanism and is locked into position inside a bore by a resilient seal. Even when caking phenomena appear at the face of the pipe, the cross-section of the opening will remain equal no matter how long the device is used. Similar attachments can, of course, also be secured to the sides of the closing mechanism. In this event it will be necessary only to construct the closing mechanism in itself independent of its actual drive means and to ensure that it can slide back and forth as hereintofore described.

The ancillary valve-drive mechanism can include a spring to compensate for the play between the means of activation employed. It is practical for the spring to be a compression spring positioned where, when released, it will move the valve's adjusting component into the closure position.

It is also possible to connect the throttle to the shut-off valve with an electric shaft so that they can be operated simultaneously. The ancillary drive mechanism employed in this case can comprise at least one signal-activated servo motor that receives signals from a control unit that prescribe the characteristics for operating the internal combustion engine. This makes it possible to operate the shut-off valve optimally even when the current characteristics for operating the internal combustion engine differ considerably from the normal, which can happen in the case of a malfunction for example.

The ancillary drive mechanism can comprise an electromagnet. This embodiment is inexpensive to maintain and especially easy to operate.

The shut-off valve's drive means can have a component that relatively delays its opening and synchronizes its closing with the throttle. A component of this type can consist for example of an unsymmetrical fluid flow damper. Such fluid flow dampers are in themselves known. They are employed for example as shock absorbers in motor-vehicle suspension systems.

The preferred embodiments of the present invention will now be described with reference to the accompanying drawings.

DESCRIPTION OF THE PREFERRED EMBODIMENT

Figure 1:
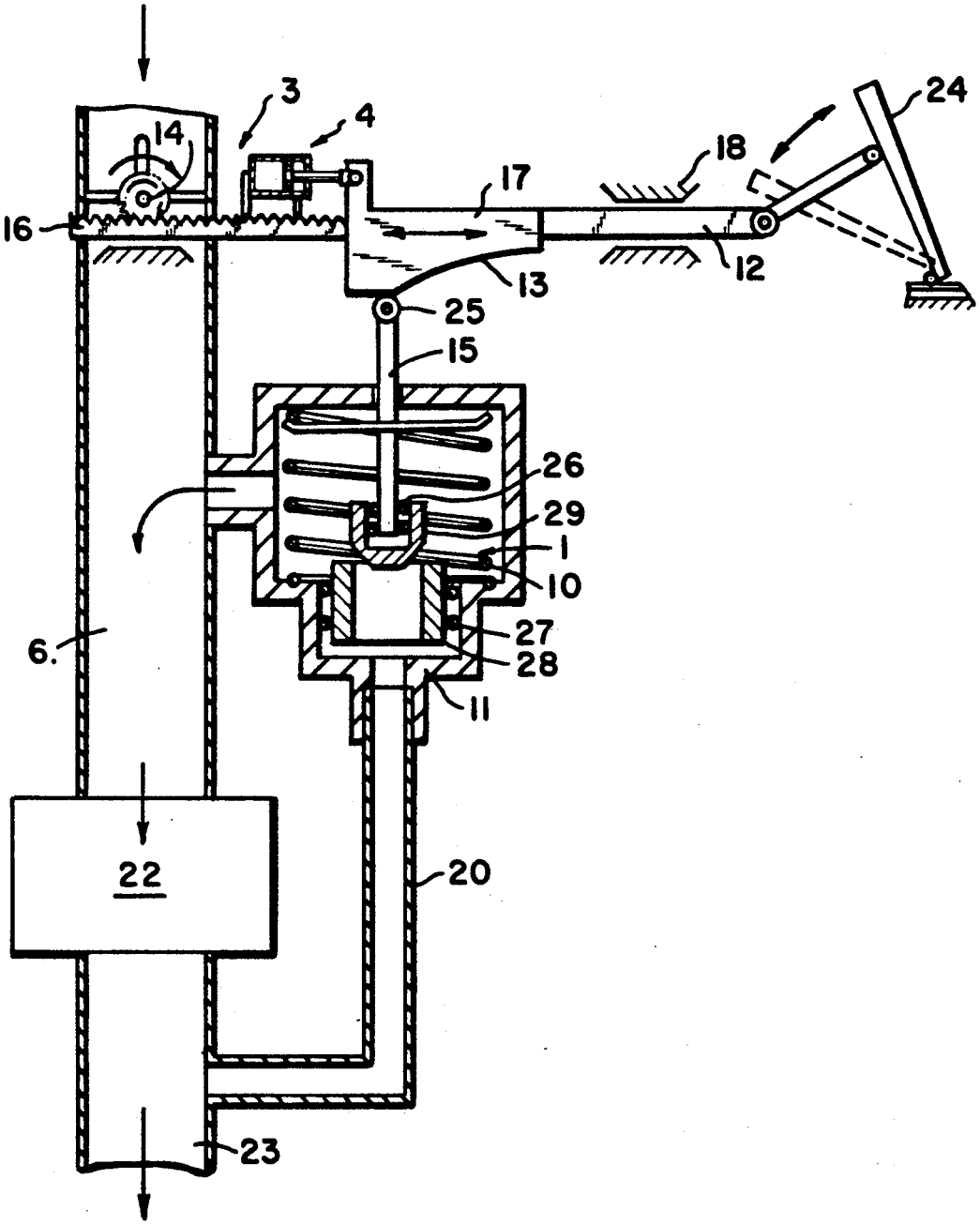
FIG. 1 is a schematic representation of a device for recycling exhaust gases for an internal combustion engine according to the preferred embodiment of the present invention.

FIG. 1 is a schematic illustration of a device for supplying combusted gases at a controlled rate to the combustion chamber of an internal combustion engine 22 with an intake pipe 6, that accommodates a throttle 3, and an exhaust pipe 23. Intake pipe 6 and exhaust pipe 2 communicate through a line 20 with a shut-off valve 1 accommodated therein. Associated with the shut-off valve 1 and throttle 3, respectively, are control means for operating these devices. Accommodated in the intake pipe 6 is a throttle 3 that is rigidly mounted on the outer circumference of a shaft 14. Outside the intake pipe 6, the throttle shaft 14 has a cogged wheel that engages a rack 16. Rack 16 is connected to a gas pedal 24 by a thrust rod 12 and can be relatively displaced back and forth, occasioning a relative rotation on the part of throttle shaft 14 and accordingly simultaneously varying the relation between throttle 3 and the surrounding inner surface of intake pipe 6. The volume of gas that can be advanced through intake pipe 6 per unit of time can accordingly be varied as necessary.

The shut-off valve 1 is actuated by a thrust rod 15 and a cam 25 which follows the cam surface 13 on the cam member 17.

To ensure that the characteristic for opening the shut-off valve 1 will remain constant over the long term, the closing mechanism 29 and valve seat 28 in the illustrated embodiment are secured interlocked in the opening direction but able to travel back and forth on their associated supporting components. Closing mechanism 29 rests for this purpose on resilient gaskets 26 made of a heat-resistant material on a columnar section of an adjusting component 15 that parallels the opening direction, and a pipe face that constitutes the valve seat 28 rests similarly on two resilient gaskets 27. Depending upon the extent of the deposits that occur over time in the vicinity of the mutually engaging surfaces of closing mechanism 29 and valve seat 28, the relative displacement of both components into the closing position will be relatively great, eventually resulting in a completely unaltered opening characteristic as the operation continues. A similar objective can also be attained when only one of the two components is mounted in such a way as to be relatively displacable.

The embodiment has illustrated in FIG. 1 has an ancillary drive mechanism 4 for the shut-off valve 1. This mechanism consists of an electromagnet that rests on the rack 16 and is attached to a cam 17. This makes it possible, depending on the particular circumstances, to displace the cam along the rack 16 and thereby vary the opening characteristic of shut-off valve 1 in relation to throttle 3 and adapt it to various situations. This potential is of major advantage in ensuring optimal operations although it can be eliminated if necessary, in which case the cam will be rigidly secured to rack 16.

Figure 2:
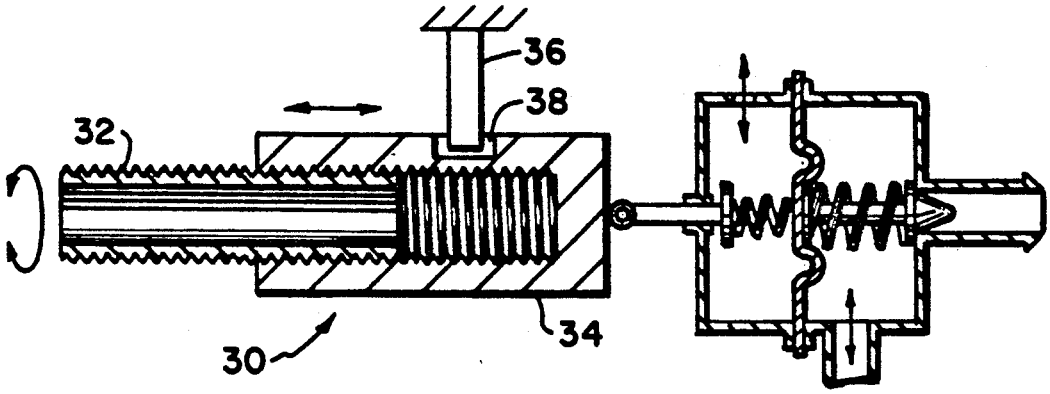
FIG. 2 is a schematic representation of the actuating mechanism for the device of FIG. 1 according to a first modification.

The actuating mechanism for the shut-off valve 1 can take on a number of alternative forms. FIG. 2 shows a spindle drive 30 having a central, threaded spindle 32 which is screwed into an actuating member 34. The spindle 32 is mechanically coupled to rotate with the throttle. The member 34 is movable axially, upon rotation of the spindle 32 and causes the shut-off valve element to open and close. The member 34 is prevented form rotating by means of a pin 36 which protrudes into a slot 38.

Figure 3:
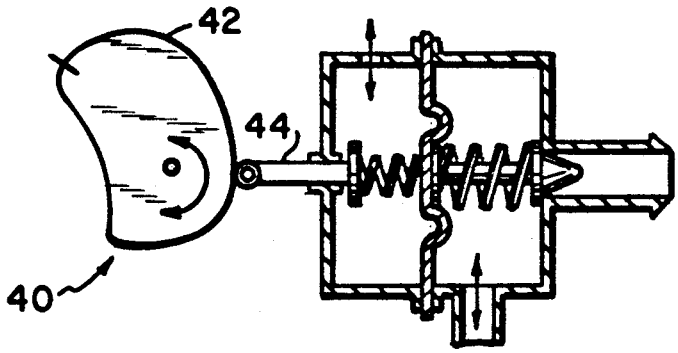
FIG. 3 is a schematic representation of an actuating mechanism for the device of FIG. 1 according to a second modification.

FIG. 3 shows a cam drive 40 have a cam disc 42 arranged to rotate with the throttle. A cam follower 44 converts the rotational movement of the cam into linear movement of the shut-off valve element.

Figure 4:
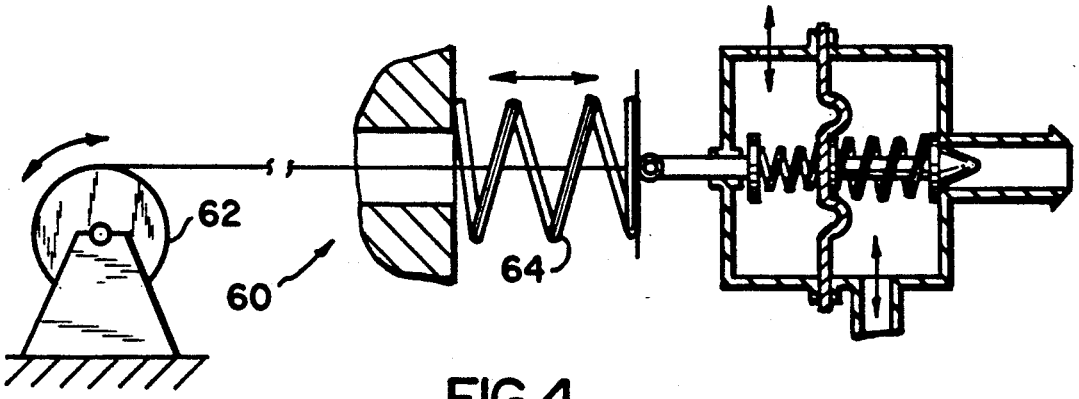
FIG. 4 is a schematic representation of an actuating mechanism for the device of FIG. 1 according to a third modification.

FIG. 4 shows an actuating mechanism having a Bowden cord 60. This cord is wrapped around a spindle 62 which rotates with the throttle. Tension is maintained in the Bowden cord by means of a coil spring 64.

There has thus been shown and described a novel device for supplying combusted gases to the combustion chamber of an internal combustion engine at a controlled rate which fulfills all the objects and advantages sought therefor. Many changes, modifications, variations and other uses and applications of the subject invention will, however, become apparent to those skilled in the art after considering this specification and the accompanying drawing which discloses the preferred embodiment thereof. All such changes, modifications, variations and other uses and applications which do not depart from the spirit and scope of the invention are deemed to be covered by the invention, which is to be limited only by the claims which follow.

What is claimed is:

1. In a device for supplying combusted gases at a controlled rate to the combustion chamber of an internal combustion engine having an intake pipe that accommodates a throttle; an exhaust pipe; an external gas recycling line connecting the intake pipe with the exhaust pipe, said line having a shut-off valve accommodated therein; means for controlling the shut-off valve and means for controlling the throttle; the improvement comprising a common actuating mechanism for actuating both said means for controlling the shut-off valve and said means for controlling the throttle; wherein the actuating mechanism comprises a rack and pinion;

whereby said shut-off valve and said throttle can be actuated only in common.

2. In a device for supplying combusted gases at a controlled rate to the combustion chamber of an internal combustion engine having an intake pipe that accommodates a throttle; an exhaust pipe; and external gas recycling line connecting the intake pipe with the exhaust pipe, said line having a shut-off valve accommodated therein; means for controlling the shut-off valve and means for controlling the throttle; the improvement comprising a common actuating mechanism for actuating both said means for controlling the shut-off valve and said means for controlling the throttle; wherein the actuating mechanism comprises an ancillary drive mechanism for the shut-off valve; wherein the ancillary drive mechanism includes a signal-activated servo motor that is responsive to a control unit that prescribes characteristics for operating the internal combustion engine; and wherein the ancillary drive mechanism comprises an electromagnet.

3. The device defined in claim 2, wherein the control unit including sensors for continuously intercepting internal combustion engine characteristics and an equilibrator for optimizing the signal in accordance with the particular value of the characteristics.

4. In a device for supplying combusted gases at a controlled rate to the combustion chamber of an internal combustion engine having an intake pipe that accommodates a throttle; an exhaust pipe; and external gas recycling line connecting the intake pipe with the exhaust pipe, said line having a shut-off valve accommodated therein; means for controlling the shut-off valve and means for controlling the throttle; the improvement comprising a common actuating mechanism for actuating both said means for controlling the shut-off valve and said means for controlling the throttle; and wherein the means for controlling the shut-off valve include a mechanism for relatively delaying the opening, and for synchronizing the closing, of the throttle.

5. The device defined in claim 4, wherein the mechanism is an unsymmetrical fluid flow damper.

6. In a device for supplying combusted gases at a controlled rate to the combustion chamber of an internal combustion engine having an intake pipe that accommodates a throttle; an exhaust pipe; an external gas recycling line connecting the intake pipe with the exhaust pipe, said line having a shut-off valve accommodated therein; means for controlling the shut-off valve and means for controlling the throttle; the improvement comprising a common actuating mechanism for actuating both said means for controlling the shut-off valve and said means for controlling the throttle; wherein the actuating mechanism comprises an ancillary drive mechanism for the shut-off valve;

whereby said shut-off valve and said throttle can be actuated only in common.

7. The device defined in claim 6, wherein the shut-off valve has a closing mechanism that can engage a valve seat and wherein at least one of the closing mechanism and the valve seat interlocks with their respective supporting components in the direction the closing mechanism moves in.

8. The device defined in claim 6, wherein the ancillary drive mechanism includes a spring.

9. The device defined in claim 6, wherein the ancillary drive mechanism includes a signal-activated servo motor that is responsive to a control unit that prescribes characteristics for operating the internal combustion engine.

* * * * *